United States Patent [19]

Boris et al.

[11] Patent Number: 4,818,421

[45] Date of Patent: Apr. 4, 1989

[54] FABRIC SOFTENING DETERGENT COMPOSITION AND ARTICLE COMPRISING SUCH COMPOSITION

[75] Inventors: Felicia J. Boris, Flanders; Charles A. Beagle, South Plainfield, both of N.J.

[73] Assignee: Colgate-Palmolive Co., Piscataway, N.J.

[21] Appl. No.: 98,347

[22] Filed: Sep. 17, 1987

[51] Int. Cl.[4] ..... C11D 1/86

[52] U.S. Cl. ..... 252/8.8; 556/445; 528/29; 252/90; 252/174.21; 252/174.12; 252/174.22; 252/174.11

[58] Field of Search ..... 252/8.8; 556/445; 528/29

[56] References Cited

U.S. PATENT DOCUMENTS

| | | | |
|---|---|---|---|
| 3,095,373 | 6/1963 | Blomfield | 252/8.8 |
| 3,828,087 | 8/1974 | Pittman | 260/448.2 B |
| 3,992,332 | 11/1976 | Zenon | 252/548 |
| 4,108,600 | 8/1978 | Wong | 8/137 |
| 4,264,457 | 4/1981 | Beeks | 252/8.75 |
| 4,298,480 | 11/1981 | Wixon | 252/8.75 |
| 4,427,410 | 1/1984 | Chirash | 8/137 |
| 4,441,881 | 4/1984 | Ruppert | 8/137 |
| 4,571,303 | 2/1986 | Ciallella | 252/174.23 |
| 4,659,496 | 4/1987 | Klemm | 252/90 |
| 4,661,287 | 4/1987 | Crossin | 252/542 |

OTHER PUBLICATIONS

Rosen, Surfactants and Interfacial Phenomena, 1978, p. 215.

*Primary Examiner*—John F. Niebling
*Assistant Examiner*—Isabelle Rodriquez
*Attorney, Agent, or Firm*—Bernard Lieberman; Murray M. Grill

[57] ABSTRACT

A fabric softening detergent composition includes, as essential components thereof, nonionic detergent, builder for the nonionic detergent, fabric softening cationic compound and silicone glycol copolymer. The silicone glycol copolymer is one that has an HLB number in the range of 4 to 7, due to the presence in the molecule of a polyethoxy polypropoxy chain, and said copolymer surprisingly improves the fabric softening capability of the cationic compound. The nonionic detergent may be either a broad range ethoxylate (BRE) or a narrow range ethoxylate (NRE) and the builder may be of a phosphate or non-phosphate type, but non-phosphate detergent compositions based on NRE nonionic detergents are preferred.

In a preferred embodiment of the invention a fabric softening detersive article, the fabric softening detergent composition, in particulate form, is present in premeasured amount in a permeable fabric pouch. One or two of such articles may be added to the wash water in an automatic washing machine, and will satifactorily wash and soften laundry.

Also with the invention are a process for manufacturing the particulate detergent composition, a liquid composition employed in such manufacturing process, and methods of washing and softening laundry, using the compositions and articles of the invention.

33 Claims, 2 Drawing Sheets

FABRIC SOFTENING DETERGENT COMPOSITION AND ARTICLE COMPRISING SUCH COMPOSITION

BACKGROUND OF THE INVENTION

1. Field of the Invention

This application relates to a fabric softening detergent composition. More particularly, it relates to such a composition in particulate form, which may be employed directly or in a fabric softening detersive article, comprising such a composition in a permeable container, such as a flexible pouch, through permeable walls of which composition components are transportable to wash water during automatic washing machine washing of laundry.

2. Description of the Related Art

Prior to the present invention it was known to make particulate built nonionic synthetic organic detergent compositions, and several such products have been commercially marketed, including All® and Fresh Start®. Also, fabric softening cationic compounds, such as quaternary ammonium halides, have been known to be useful as fabric softening agents, and have been included in liquids, such as Downy®, intended for treatment of laundry in washing machine rinse water, and in papers, such as Bounce®, for use in automatic laundry dryers. Despite generally undesirable interactions of quaternary ammonium halides with anionic detergents and/or alkaline builders, heavy duty laundry detergents, such as Fab® (with fabric softener) and Bold®-3, have been marketed, apparently with additional detergent and softener being included in the formula to compensate for any losses due to such undesirable reactions.

Silicones, siliconates and organosilicones have been taught in the literature to be useful components of detergent compositions, as in U.S. Pat. Nos. 4,013,573, 4,136,045 and 4,419,250, for various purposes, including soil release promotion, suds suppression and flow promotion. Additionally, some silicones have been suggested for employment with antistatic agents in antistatic detergent compositions, as in U.S. Pat. No. 3,992,332, others have been taught to be useful lubricants for fibers, sometimes in combination with detergents, as in U.S. Pat. No. 4,578,116, and others have been suggested for use as fabric softeners, as in U.S. Pat. No. 4,579,964.

Silicone glycol copolymers like those employed in the present invention are sold by Dow Corning Corporation, which designates such materials as their 190 Surfactant. Such materials are described in an information bulletin published by Dow Corning Corporation and indicated to have been copyrighted in 1980, which is entitled *Information about Cosmetic Ingredients.* Such materials are also identified as dimethicone copolyol (CTFA name) and are described in U.S. Pat. No. 3,402,192, hereby incorporated by reference.

With respect to the preferred article embodiments of the invention, single use packets of detergent compositions and bleaches are described in U.S. Pat. Nos. 4,220,153, 4,286,016, 4,348,293, 4,374,747, 4,410,441 and 4,567,675; British Pat. Nos. 1,578,951, and 1,587,650; and European Pat. No. 0,184,261, but applicants' solution to the problems of effectively softening, lowering residue and eliminating quat spotting (staining of laundry with greasy spots from the quaternary salt) is not suggested by any of them.

Although the silicone glycol copolymers of the present compositions are not new per se, and although silicones have been employed in detergent compositions in the past and are known to have lubricating and, in some circumstances, fabric softening properties, the invented compositions and articles are not obvious from the prior art because nowhere in the art is it indicated or suggested that in detergent compositions, like those of this invention, the presence of the mentioned silicone glycol copolymer will increase the fabric softening activity of a fabric softening cationic compound component, which allows a reduction to be made in the quantity of such compound in the detergent composition while still producing satisfactory fabric softening, which reduction, in turn, facilitates emptying of the fabric softening detergent composition from a permeable container, such as a permeable pouch in which it was packed, and which was charged to an automatic washing machine to effect machine washing and fabric softening of laundry. Because the pouch has been emptied of cationic compound such is not present in the pouch when it is placed in a dryer with the washed and rinsed laundry, so quat spotting is prevented.

SUMMARY OF THE INVENTION

In accordance with the present invention a fabric softening detergent composition comprises a detersive proportion of nonionic detergent, a building proportion of builder for the nonionic detergent, and a fabric softening proportion of a combination of fabric softening cationic compound and silicone glycol copolymer, for which copolymer a hydrophilic-lipophilic balance number is in the range of 4 to 7, and in which the copolymer is of ethylene glycol and propylene glycol, wherein the proportion of silicone glycol copolymer significantly improves the fabric softening action of the fabric softening cationic compound. Also within the invention is a fabric softening detersive article comprised of the described fabric softening detergent composition, in particulate form, in a permeable container, through walls of which it is dispensable during automatic washing machine washing of laundry. Other aspects of the invention include a process for manufacturing the particulate detergent composition, a liquid composition employed in such manufacturing process, and methods of washing and softening laundry, using the compositions and articles of the invention.

The reason why the particular silicone glycol copolymers of the present compositions improve the fabric softening action of the fabric softening cationic compounds in wash waters containing the claimed detergent compositions is not known. It has been theorized that the silicone copolymer increases the deposition of the fabric softening cationic compound on laundry, such as on items which include fabrics containing polyester fibers, but comparative analyses of washed laundry, with and without the silicone glycol copolymer in the detergent formula, do not confirm such theory. Rather, it appears from substantive dye tests, which indicate the distribution of the cationic softening compound over the washed laundry, that the silicone copolymer helps to distribute the softening compound more evenly, thereby making it more effective. However, the present application should not be limited by such theory, which has not been sufficiently confirmed. Nevertheless, it has been observed that significantly lesser quantities of fabric softening cationic compound are required to effect satisfactory softening of washed laundry when the described silicone glycol copolymer is present in the fabric softening laundry detergent composition, compared to when it is omitted.

Whatever the mechanism for improvement of fabric softening by the present compositions such improvement has been established as significantly beneficial and certainly it is unexpected. Other silicones do not yield such improvements and even other silicone glycol copolymers that have been polyethoxylated do not have the desired synergistic effect on fabric softening by cationic agents.

The nonionic detergent of the present compositions is any suitable nonionic detergent, which class is well known in the art, with many members thereof being described in the various annual issues of *Detergents and Emulsifiers*, by John W. McCutcheon, for example, the 1973 Annual. Such volumes give chemical formulas and trade names for virtually all commercial nonionic detergents marketed in the United States, and substantially all of such detergents can be employed in the present compositions. However, it is highly preferred that such nonionic detergent be a condensation product of ethylene oxide and higher fatty alcohol (although instead of the higher fatty alcohol, higher fatty acids and alkyl phenols may also be employed). The higher fatty moieties, such as the alkyls, of such condensation products, will normally be linear, of 10 to 18 carbon atoms, preferably of 10 to 16 carbon atoms, more preferably of 12 to 15 carbon atoms and sometimes most preferably of 12 to 14 carbon atoms. Because such fatty alcohols are normally available commercially only as mixtures the numbers of carbon atoms given are necessarily averages but in some instances the ranges of numbers of carbon atoms may be actual limits for the alcohols employed and for the corresponding alkyls.

The ethylene oxide (EtO) content of the nonionic detergent will normally be in the range of 3 to 15 moles of EtO per mole of higher fatty alcohol, although sometimes as much as 20 moles of EtO may be present. Preferably such proportion will be 3 to 10 moles and more preferably it will be 6 to 7 moles, e.g., 6.5 or 7 moles, per mole of higher fatty alcohol (and per mole of nonionic detergent). As with the higher fatty alcohol, the polyethoxylate limits given are also limits on the averages of the numbers of EtO groups present in the condensation product. Both broad range ethoxylates and narrow range ethoxylates (BRE's and NRE's) may be employed, with the difference between them being in the "spread" of numbers of ethoxylate groups present, which average within the ranges given. For example, NRE's which average 5 to 10 EtO groups per mole in the nonionic detergent will have at least 70% of the EtO in polyethoxy groups of 4 to 12 moles of EtO and will preferably have over 85% of the EtO in such range. BRE nonionic detergents have a broader range of ethoxy contents than NRE's, often with a spread of 1 to 15 moles of EtO when the EtO content is in the 5 to 10 range (average). Examples of the BRE nonionic detergents include those sold by Shell Chemical Company under the trademark Neodol®, including Neodol 25-7, Neodol 23-6.5 and Neodol 25-3. Supplies of NRE nonionic detergents have been obtained from Shell Development Company, which identifies such materials as 23-7P and 23-7Z, and from Union Carbide Corporation, which identifies such a product as Tergitol 24-L-60N. The present NRE's and "corresponding" BRE's are described in U.S. patent application Ser. No. 084,524 (Holland and Buda), filed Aug. 10, 1987, which recites advantages of the NRE's.

The builder for the nonionic detergent may be any suitable water soluble or water insoluble builder, either inorganic or organic, providing that it is useful as a builder for the particular nonionic detergent or mixture of nonionic detergents that may be employed. Such builders are well known to those of skill in the detergent art and include: alkali metal phosphates, such as alkali metal polyphosphates and pyrophosphates, including alkali metal tripolyphosphate; alkali metal silicates, including those of $Na_2O:SiO_2$ ratio in the range of 1:1.6 to 1:3.0, preferably 1:2.0 to 1:2.8, and more preferably 1:2.35 or 1:2.4; alkali metal carbonate; alkali metal bicarbonate; alkali metal sesquicarbonate (which may be considered to be a mixture of alkali metal carbonate and alkali metal bicarbonate); alkali metal borate, e.g., borax; alkali metal citrate; alkali metal gluconate; alkali metal nitrilotriacetate; zeolites, preferably hydrated zeolites, such as hydrated Zeolite A, Zeolite X and Zeolite Y; and mixtures of individual builders within one of such types of builders, and of different types. Preferably the builders will be sodium salts and will also be inorganic. A highly preferred mixed water soluble and water insoluble builder composition comprises carbonate, bicarbonate and zeolite builders. Phosphate-containing builder systems will usually be based on alkali metal (sodium) tripolyphosphate and silicate builders, with the silicate being in minor proportion.

The various builders need no further description except, perhaps, for the zeolite. Such builder is water insoluble and is preferably hydrated, as with from 4 to 36% of water of hydration, preferably 5 to 30%, more preferably 10 or 15 to 25%, and most preferably, 17 to 22%, e.g., about 20%. The zeolite is normally in a finely divided state, with particle sizes often being less than No. 200 sieve, as is also the situation for various adjuvants in powder form. Normally the zeolite particle sizes will be in the range of Nos. 100 to 400, preferably 140 to 325, U.S. Sieve Series, but such particles may be agglomerated to builder bead size, too. The ultimate particle diameter of the zeolite will be in the range of 0.01 to 20 microns, more preferably 0.01 to 15 microns, e.g., 3 to 12 microns, and most preferably 0.01 to 8 microns, mean particle size, e.g., 3 to 7 microns, if crystalline, and 0.01 to 0.1 micron, if amorphous.

The silicone glycol copolymer is a copolymer with the silicone of a mixed ethylene oxide-propylene oxide or ethylene glycol-propylene glycol copolymer (designated EtO-PrO copolymer, for conciseness), in which the EtO-PrO copolymer moieties are joined to silicone silicon atoms through lower alkylene groups. A suitable such silicone glycol copolymer product, which products are also called dimethicone copolyols, using CFTA terminology, is available from Dow Corning Corporation, under the designation, 190 Surfactant. Such material is in liquid form at room temperature, is soluble in water, ethanol and water-ethanol systems and is hydrolytically stable. It is of a lower surface tension than water, being comparable in this respect to aqueous synthetic organic detergent solutions and soap solutions. Its specific gravity is slightly higher than that of water, and it approaches water whiteness in appearance. Such silicone glycol copolymer (SGC) is non-oily, essentially non-toxic and non-sensitizing, stable and inert, and is of inverse solubility, with its inverse solubility point (0.1% aqueous solution) being about 36° C. The HLB number for 190 Surfactant is in the range of 4 to 7, normally being about 5.7, and such range applies to other SGC's, but other similarly active SGC's of HLB's up to 19 may also be employed.

The silicone glycol copolymer (190 Surfactant) is reported to be like such copolymers that are described in U.S. Pat. No. 3,402,192, previously mentioned herein. Such copolymer is of the formula

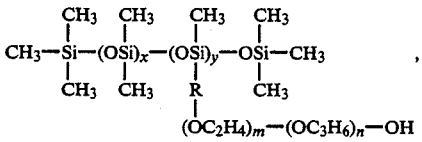

wherein R is a hydrocarbyl radical of 1 to 30 carbon atoms, x is 6 to 420, y is 3 to 30, and $m+n=25$ to 100, with the molar proportion of ethoxy groups to propoxy groups being in the range of 1:4 to 7:3. In that formula R is preferably lower alkylene of 1 to 30 carbon atoms, more preferably and most preferably 3 or about 3 carbon atoms. In such formula x is 6 to 420, preferably 10 to 350, and more preferably 20 to 200, y is 3 to 30, preferably 5 to 25 and more preferably 8 to 20, m+n is 25 to 200, preferably 40 to 80 and more preferably 45 to 75, and the molar proportion of ethoxy groups to propoxy groups is in the range of 1:4 to 7:3, preferably being in the range of 1:2 to 2:1 and more preferably being in the range of 2:3 to 3:2. Other silicone glycol copolymers which may be useful in the practice of the present invention include 193 Surfactant, also available from Dow Corning Corporation, and Silwet L-7001, available from Union Carbide Corporation.

The fabric softening cationic compound may be any suitable such compound, such as an imidazolinium salt or a quaternary ammonium salt. Both types of fabric softeners are described in U.S. Pat. No. 4,000,077. Of the two types of softeners the quaternary ammonium salts are preferred, and of these the quaternary ammonium halides, such as the quaternary ammonium chlorides, are more preferred.

The quaternary ammonium salt fabric softening compound is preferably of the formula

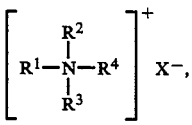

wherein $R^1$ and $R^2$ are lower alkyls of 1 to 3 carbon atoms, $R^3$ is higher alkyl of 10 to 20 carbon atoms, $R^4$ is alkyl of 1 to 20 carbon atoms, and $X^-$ is a salt forming anion, preferably either chlorine or bromine, and more preferably chlorine. In such quaternary salts $R^1$ and $R^2$ are preferably the same lower alkyl and $R^3$ and $R^4$ are preferably the same higher alkyl, with the most preferred fabric softener being dimethyl distearyl ammonium chloride. The useful quaternary ammonium halides include those wherein the higher alkyls are tallowalkyl or hydrogenated tallowalkyl, cetyl, myristyl and/or lauryl, and wherein the lower alkyls are methyl and/or ethyl.

Various other components may be present in the detergent composition to improve its properties and in some cases, to act as diluents or fillers. Among the suitable fillers the one most preferred is sodium sulfate. Among the adjuvants there may be listed soil release promoting agents, such as the polyethylene terephthalate-polyoxyethylene terephthalate (PET-POET) soil release promoting copolymers, of molecular weights in the range of 19,000 to 43,000, with the molecular weight of the polyoxyethylene thereof being in the range of about 2,500 to 5,000, with the molar ratio of PET-POET units being in the range of 2:1 to 5:1, and with the proportion of ethylene oxide to phthalic moiety in the copolymer being in the range of 20:1 to 30:1. Enzymes may be present to promote cleaning of hard to remove stains from the laundry. Of the enzymes the most useful in laundering operations are the proteolytic and amylolytic enzymes, preferably in mixture. Polyacrylates, such as sodium polyacrylate of molecular weight in the range of 1,000 to 3,000, are useful for their dispensing properties and also function as stabilizers for the PET-POET copolymer, which stabilizing action is of importance with respect to obtaining most effective promoting of removal of soil from laundry, especially laundry items made of polyester fabrics. Flow promoting agents, such as hydrated synthetic calcium silicate, often sold under the trademark Microcel ®C, may be employed in relatively small proportions for their mentioned function. Additional components of the fabric softening detergent composition include: fluorescent brighteners, such as the stilbene brighteners; perfumes; colorants, including dyes and water dispersible pigments; and water.

The proportions of the various components of the present compositions that are of significance with respect to operativeness of the invention will be chosen to produce the desired result, good detergency, good fabric softening, substantially complete evacuation of a permeable pouch when the composition is packed in such a pouch, no quat spotting or yellowing of the laundry, and no significant adverse effects of the quaternary ammonium halide softening agent on any fluorescent brightener that may also be present in the compositions. The content of nonionic detergent in the detergent composition will normally be in the range of 8 to 40%, preferably being 12 to 25%, more preferably being 14 to 20% and most preferably being 16% or about 16%. The content of builder(s) will normally be in the range of 30 to 70%, preferably being 40 or 50 to 70%. When the builder system is non-phosphate the proportions of sodium carbonate, sodium bicarbonate and hydrated zeolite (as its anhydride) will be in the ranges of 15 to 35%, 5 to 20% and 10 to 35%, respectively, and more preferably will be at or about 30%, 12% and 22%, respectively. When the builder is a "phosphate builder system" the portion of sodium tripolyphosphate therein will preferably be in the range of 40 to 60% and the proportion of sodium siicate will be in the range of 3 to 8%. Most preferably such contents will be at or about 48% and 5%, respectively. In the non-phosphate detergent composition the weight of sodium carbonate will be from 0.7 to 1.5 times the weight of zeolite (anhydrous basis) and the weight of sodium bicarbonate will be from 0.3 to 0.7 times the weight of sodium carbonate. In the phospate detergent composition the phosphate or tripolyphosphate will be from 5 to 20 times the weight of the silicate.

The content of silicone glycol copolymer in the invented detergent composition will normally be in the range of 0.5 to 8% thereof, preferably being 0.5 to 5%, more preferably being about 1 to 3% and most preferably being about 1 to 2%, e.g., about 1 to 2%. It has recently been found that as little as about 1% of the 190 Surfactant can satisfactorily improve the fabric softening capability of about 5% of quaternary ammonium halide so that such mix can replace about 8% of such quaternary compound of a previous acceptable fabric softening detergent composition of the same general type (with the "control" including anionic surfactant to promote transport of the composition through a permeable pouch), and satisfactory solubility of the composition and transport thereof through a permeable pouch is obtainable, when that is desirable. Accordingly, a most preferred formulation of the invention now includes as little as about 1% of the silicone glycol copolymer. More of such copolymer may be employed, if desired, and further improvements due to its presence are obtainable, but for economy any such "excesses" will often be avoided.

The fabric softening cationic compound will normally be from 0.5 to 10% of the fabric softening detergent composition, preferably being 1 to 6% thereof, more preferably being 3 to 6% and most preferably being 4 to 5.5% or about 4 or 5%. The moisture contents of the detergent compositions may vary, depending on whether the composition is a phosphate or a non-phosphate formula. The phosphate-containing compositions are designed to contain 8 to 14% of moisture, preferably 9 to 12% thereof and more preferably about 11%, whereas the non-phosphate formulas will usually contain 5 to 10%, preferably 6 to 9% and more preferably about 7 or 8%. The balances of the detergent compositions will usually be of adjuvants and/or fillers, the more important of which have already been mentioned. The soil release promoting PET-POET copolymer content will normally be in the range of 1 to 5%, preferably 2 to 4%, and more preferably will be about 3% and the proportion of sodium polyacrylate stabilizer for the PET-POET copolymer is normally in the range of 0.25 to 1.25%, preferably being 0.5 to 1%, and more preferably being about 0.7 to 0.75%. The enzymes content of the detergent composition will normally be in the range of 0.5 to 3%, preferably 0.5 to 2%, and more preferably about 1%, and the Microcel C or hydrated synthetic calcium silicate flow promoting powder content will be from 0.3 to 3%, preferably 0.5 to 2%, and more preferably will be about 0.7%. Ranges of contents of fluorescent brightener and perfume are normally 0.2 to 2%, preferably 0.3 to 1% and more preferably about 0.5%, and 0.3 to 2%, preferably 0.3 to 1% and more preferably about 0.4%, respectively. The percentages and ranges of percentages given above are all on a final product ¢as is" basis except for the zeolite, which has already been discussed. When in this specification, and in the claims, composition components, such as nonionic detergent, fabric softening compound, silicone glycol copolymer and builder, are mentioned in the singular but are not specifically identified, it is to be understood that more than one of such is also encompassed by such description, and percentages given relate to such individual components or to mixtures thereof.

In manufacturing the fabric softening detergent composition of this invention conventional spray drying procedures may be substantially followed, with some modification. Thus, base beads, usually of inorganic builder, are made by mixing together an aqueous crutcher mix of such a builder mixture, usually at a solids content in the range of 40 or 50 to 75%, at a temperature in the 40°-75° C. range, and spray drying it in a conventional spray tower at a drying gas temperature in the range of 250° to 450° C., to produce substantially globular beads of particle sizes in the range of 10 to 100, preferably 10 to 60, U.S. Sieve Series. Fluorescent brightener, such as stilbene brightener, and any other heat stable adjuvants and fillers, may be incorporated in the crutcher mix, to be dried with the builder(s). If such spray drying results in larger and smaller particles also being produced, as it usually does, they may be screened or air classified to the desired range or to another such range considered as acceptable for the purpose intended. The spray dried beads, after cooling, then have nonionic detergent in liquid state absorbed therein, by spraying the desired nonionic liquid detergent, either a BRE or an NRE detergent, onto moving surfaces of the beads. A processing advantage of the use of NRE's is that they liquefy nearer to room temperature than the BRE's, and accordingly, need little or no heating for liquefaction. Also, it is considered that they penetrate better into the interiors of the spray dried base beads at a given temperature, which can improve processing and can result in freer flowing product. In a preferred aspect of the manufacturing process, utilized in making the compositions of this invention, instead of spraying onto the base beads liquid state nonionic detergent only, there is sprayed onto such beads a relatively low temperature mutual solution of the silicone glycol copolymer and nonionic detergent. While such mutual solution may be at a more elevated temperature, such as up to 50° or 60° C. in some instances, it is preferred to keep its temperature as low as feasible, normally in the 10° to 40° C. range, preferably 15° to 30° C., and more preferably, about room temperature (which is usually about 20° to 25° C.). The nonionic detergent and SGC are liquid or nearly liquid at such temperatures, and so are mixtures thereof, so no additional solvents are required. In such solutions the proportion of SGC to nonionic detergent will be in the range of 1:30 to 1:4, preferably being in the range of 1:20 to 1:6 and more preferably being in the range of about 1:16 to 1:8. Normally such mutual solutions of SGC and nonionic detergent will comprise 3 to 20% of SGC and preferably such content will be 4 to 15%, with the balances being nonionic detergent (preferably NRE for greater solubilities and other advantages). The mutual solution of SGC and nonionic detergent is preferably sprayed onto tumbling base beads in a suitable mixing device, such as an inclined drum, with the solution temperature most preferably being at about room temperature. After application of the solution to the base beads perfume may be similarly sprayed onto them and in some cases such spraying may occur at approximately the same time (but usually to different surfaces of the tumbling beads).

The described application of nonionic detergent and SGC to the base beads is an important process step in the manufacture of the described fabric softening detergent compositions. The greater proportion of nonionic detergent serves to help distribute the SGC evenly throughout the base beads and also helps better to release it from them into wash water. Also, the inert SGC and the nonionic detergent can both help to "insulate" the cationic fabric softener from the alkaline builder salt of the base bead.

After absorption of the SGC, nonionic detergent and perfume by the base beads there are then mixed together such resulting particulate sub-composition, enzyme mixture, soil release promoting agent and fabric softening cationic compound, all in powdered form. The particle sizes of such powdered components will be such that they do not sift objectionably through the "pores" of any pouch or container used, and usually such powders will be No. 200, U.S. Sieve Series, or larger, when feasible. When finer powders are employed, such as those of particle sizes less than No. 200, dusting and sifting of such powders may be prevented by their adherence to larger beads, which adherence can also improve flow characteristics of the composition, which improvement assists in speeding filling of the pouches (which is effected by automatic machinery).

The soil release promoting PET-POET copolymer will best be added to and mixed with the detergent composition beads in a previously prepared blend with sodium polyacrylate, in desired proportions of such components in the composition, as was previously indicated. The fabric softening compound may be mixed with the other components alone or, as is preferable, in a previously prepared mixture with Microcel C and a wetting agent or emulsifier (preferably a polyethoxylated higher fatty alcohol of 12 to 18 carbon atoms in the higher fatty alcohol and of about 20 moles of ethylene oxide per mole). In the mixture of fabric softener, flow improving agent and emulsifier, the proportions thereof will ideally be about 5.5%, 0.1% and 0.5%, on a final product basis, which corresponds to about 90%, 1% and 9% of the mixture, respectively, ignoring about 3% of impurities, which may also be present. Corresponding useful ranges of such components are 80 to 95%, 0.2 to 5% and 4 to 15%, respectively. In addition to the Microcel C that is added in conjunction with the fabric softener and emulsifier, 0.3 to 2% (about 0.7% ideally) on a final product basis, is also blended in, with the perfumed detergent powder, enzyme mixture, PET-POET-polyacrylate blend and fabric softening mixture, for its flow improving qualities. Improvement of the flow of the product is of importance in automatic production of the detersive articles, especially in the filling of the pouches, where dependable flow of the composition to the pocket formed by the pouch material is required. Also of some importance are the anti-caking properties of the hydrated synthetic calcium silicate, which are considered to be of assistance in evacuating the pouch when the invented article is added to the wash water in an automatic washing machine.

Although it is highly preferred that the base beads of the compositions of this invention be spray dried, because spray dried beads tend to be more porous and therefore better able to absorb liquid detergent, under some circumstances granular components or agglomeratues may be employed, providing that they are sufficiently absorbent. For the manufacture of the phosphate-built detergent composition it will be preferred to employ hydrated or humidified pentasodium tripolyphosphate as a phosphate starting material, but that is not required.

In the final mixing step, when the various powders are mixed with the particulate detergent composition intermediate, the powders will tend to coat such intermediate particles but that is not to say that all such powders applied actually form coatings on the intermediate particles. Some do but some may form independent particles or may agglomerate with other additives. However, coating of the intermediate particles does appear to occur to a desirable extent, whereby flowability is increased and separation and sifting are decreased. The product resulting, although it may contain some of the added powders in finely divided form, is essentially or substantially of particle sizes in the range of 10 to 100, U.S. Sieve Series, preferably 10 to 60.

In a preferred embodiment of the invention, a fabric softening and detersive article, there are included two main components, a permeable dispensing container and the composition in it (which has previously been described). This preferred aspect of the invention will be readily understood from the description thereof herein, taken in conjunction with the accompanying drawing, in which:

DESCRIPTION OF THE DRAWINGS

In FIG. 1 pre-weighed fabric softening detergent article 11, suitable for addition to an automatic washing machine to wash an average load of laundry therein, comprises two sheets of non-woven polyester fabric, an upper sheet 13 and a lower sheet (not visible), which are heat sealed together along the four sides thereof, represented by numeral 15. The polyester fabric 13 is fabricated with diamond-shaped patterns, such as that illustrated at 17 (accentuated), which pattern extends over both surfaces of the sheet but which is flattened out by heat sealing along the sides thereof, at 15. The invented particulate fabric softening detergent composition (not visible) is contained in pouch 18, with that numeral designating the permeable covering of article 11 about the particulate contents thereof.

Article 11 is of a flat pillow shape, with the thickness thereof usually being in the range of 0.01 to 0.2 times the width of the portion of the pouch containing particulate detergent (that portion "inside" the heat sealed article sides). Ends of the pouch are illustrated in the shaded portion designated by numeral 19 and in unshaded portion 21, which portions, as illustrated, indicate the thickness of the article.

Figure 1:
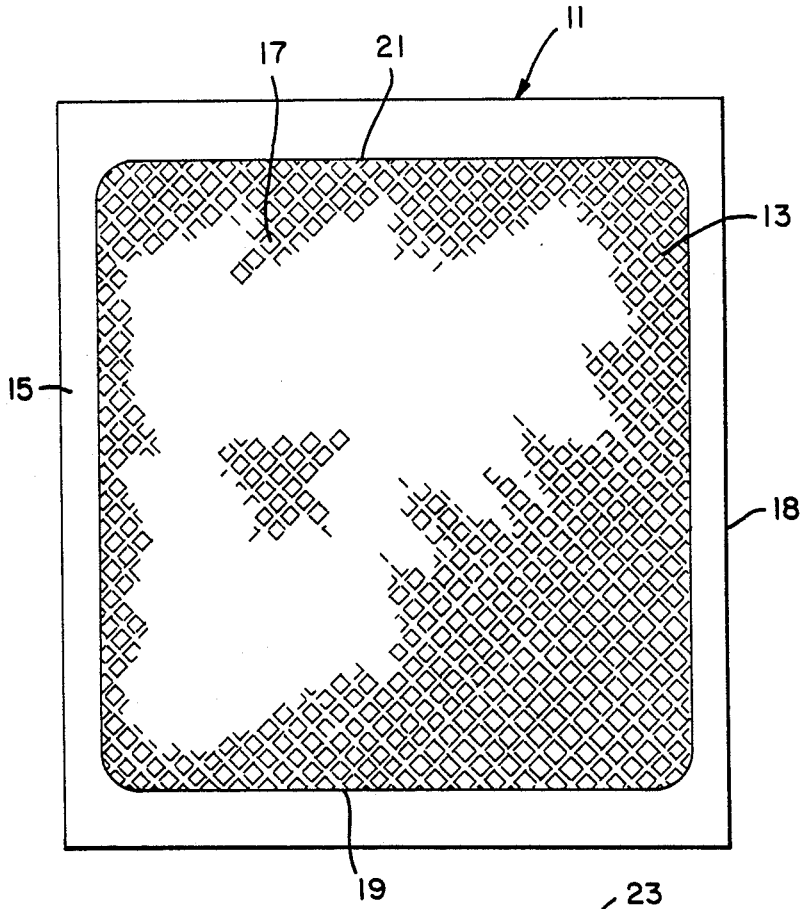
FIG. 1 is a xerographic top plan view of an actual article of the present invention.
Figure 2:
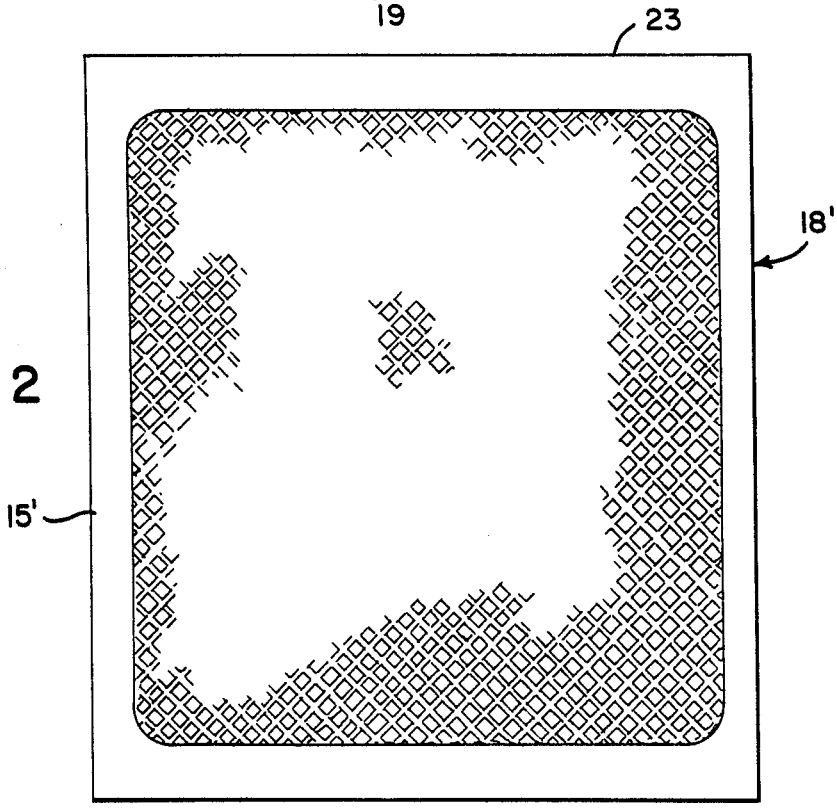
FIG. 2 is a top plan view of a pouch of the present invention, sealed on three sides and open on one side, before being filled with the invented fabric softening detergent composition.

In FIG. 2 open pouch 18' is shown, with three heat sealed sides, represented by numeral 15', and with one open end 23. Particulate fabric softening detergent composition may be added to such pouch through open end 23, after which such end may be heat sealed to produce article 21 (shown in FIG. 1).

Figure 3:
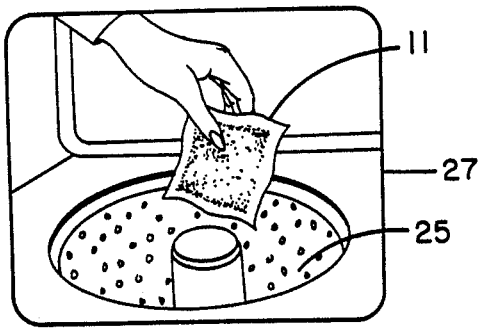
FIG. 3 is a perspective view of an article of this invention being added to the wash tub of an automatic washing machine.

In FIG. 3 there is shown article 11 of this invention being added to wash water (not shown) in tub 25 of top loading washing machine 27. Such addition is made before clothing and other items to be laundered are added to the wash water.

Figure 4:
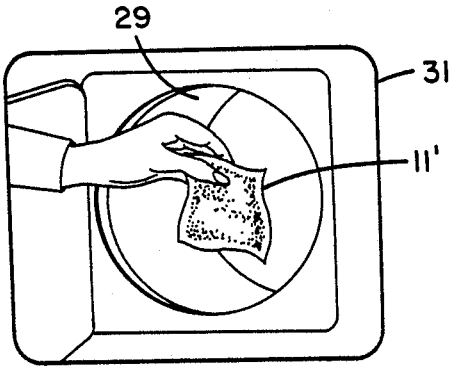
FIG. 4 is a perspective view of the empty pouch of the present invention being added to the laundry dryer after completion of treatment of the laundry.

In FIG. 4 the empty pouch or depleted fabric softening and detersive article, designated 11', is shown being added to drum 29 of side loading automatic laundry dryer 31. The pouch at this stage contains little or none of its original contents because of the effectiveness of the silicone glycol copolymer in synergistically improving fabric softening, thus allowing a reduction in the proportion of cationic softener employed, which promotes transport of the contents through the permeable walls of the pouch and into the wash water, and consequently reduces residue in the pouch after washing. Thus, the depleted article may be discarded after completion of the washing and softening of the laundry in automatic washing machine 27 or it may be dried with the laundry in automatic dryer 31, and then may be discarded. Normally the remains of the article will be dried with the laundry because it adds little drying load on the dryer, it is desirable to avoid having to separate the wet pouch from the washed laundry, and a dry pouch is more convenient to dispose of than a wet one. In instances in which another fabric softening detergent composition than that of this invention is utilized, and does not evacuate its dispensing container completely during the washing cycle, any cationic fabric softener remaining in the pouch can become fused due to the heat of the dryer and, in liquid state, can flow through the pouch onto laundry being dried. While such transport through the pouch wall in the dryer may improve fabric softening (because only part of the desired such effect was obtained in the washing machine) it can also result in "quat-spotting" of the laundry being dried, in which greasy spots of cationic softener are deposited on the laundry. Such spots, in addition to being objectionable because of their greasy nature, tend to yellow or otherwise discolor, too, and therefore are to be avoided whenever possible. Of course, such quat spotting is minimized when the articles of the present invention are employed in accordance with the procedures that have been set forth herein.

The particulate fabric softening detergent composition of the present articles, which can be employed directly or in the present articles, has already been described, generally and in detail. The water permeable, water insoluble container for such composition may be any suitable such container which allows the intrusion of water and the transport of the contained composition through permeable walls thereof into wash water. However, although it is contemplated that form retaining containers, such as those resembling perforated polyethylene or polypropylene bottles, or polyurethane sponges may also be employed, the most preferred form of container is a flexible pouch of thin material, preferably of fabric, and more preferably of non-woven fabric. Such fabric may be made from fibers or filaments of various materials, either synthetic or natural, but it is preferred that it be substantially or entirely of synthetic organic polymeric fibers. Of such fibers those of polyesters, nylons and rayons are more preferable, with polyester fibers being considered to be the best. Such fibrous materials can readily be made of desired permeability by modifying manufacturing methods, fiber size and fabric weight.

The preferred non-woven sheets or strips, used to make pouches for the present articles, will normally be of a thickness in the range of 0.1 to 1 mm., a weight in the range of 35 to 45 g./sq. m. and air permeability in the range of 1 to 3 cu. m./min./sq. cm. Air permeability is related to fluid permeability of a fabric being employed and also relates to ease of transport through such fabric of contents of a pouch. Another of the variables that affects the permeability and the preuse integrity of the pouch (non-sifting of contents through the walls thereof) is the thickness of the fibers or filaments. It has been found that preferred fibers are of 2 to 4 denier, e.g., about 3 denier. The pouch material which is preferred is that manufactured by Kendall Corporation, which company also manufactures and fills the pouches, to make the desired articles. Their fabrics, used for pouch materials, are described by their specification numbers, which include 149-026, SP 284, SP 284.1, SP 289 and SP 289.1.

The fabric softening detersive article described above will be of such size, weight, pouch material, composition and composition particle sizes as to satisfactorily wash laundry in automatic washing machines and to empty substantially all, over 90%, preferably over 95%, more preferably over 99%, and most preferably 100%, of the fabric softening detergent composition from the permeable container through permeable walls thereof, into the wash water in an automatic washing machine. Desirably, the amount of detergent composition transported into the wash water will be that amount which satisfactorily cleans and softens a washing machine load of dirty laundry. However, the size and/or weight of the invented article may be adjusted so that a plurality of such articles furnishes the requisite amount of such detergent composition. Ideally, about 49 or 50 grams of detergent composition will be present in the invented article but, depending on the proportions of components in such composition, such weight may be in the range of 10 to 200 grams, and is preferably in the range of 30 to 100 grams.

The concentration of the detergent composition in the wash water, after complete evacuation of the fabric softening detergent composition from the article, will ideally be about 0.075%, with corresponding broad and preferred ranges of 0.015 to 0.3% and 0.045 and 0.15%, respectively, (considering that the volume of wash water in the automatic washing machine tub is about 64 liters). Ideally, the concentration of nonionic detergent in the wash water will be at or about 0.012%, the ideal concentration of fabric softening compound will be at or about 0.004%, and the ideal proportions of builder salts will total or be about 0.04%, for phosphate formulas and 0.05% for non-phosphate formulas. The percentage of silicone glycol copolymer will ideally be at or about 0.0008%. Broad and preferred ranges of concentrations of such components may be calculated from corresponding ranges of concentrations of the total composition, based on the preferred individual concentrations given above.

The size of the invented article will be that which is convenient to be hand held. It has been determined that such an article which is square and measures about 10 cm. by 10 cm. (measuring the external surfaces through which, after heat sealing, composition components may be transported to the wash water) is ideal but other sizes and shapes may also be employed. Thus, the total permeable surface area, measured externally, may be in the range of 100 to 500 sq. cm. and ideally, will measure about 200 sq. cm. ($2\times10$ cm. $\times$ 10 cm.). For such a product the thickness of the article, after filling of the pouch, will be about 1 cm. but thicknesses within the range of 0.5 to 4 cm., preferably 0.8 to 2 cm., are feasible, often with corresponding adjustments of the composition bulk density and of the permeability characteristics of the pouch material. Such bulk density will normally be comparatively high, such as from 0.4 to 0.8 g./cu. cm., preferably 0.5 to 0.7 g./cu. cm.

With respect to pouch permeability, the weave of the woven fabrics and the deposit of fibrous materials of the non-woven fabrics should be tight enough to prevent undesirable siftings of particulate material out of the article before use and yet should be sufficiently loose to permit transport of liquids and undissolved fine particles of the contained composition through the permeable material of the pouch or container wall. It has been found that with the preferred pouch materials of this invention, utilizing the preferred compositions, of reduced cationic softener content, and with SGC, the pouch is essentially completely emptied in normal cold water (21° C.) washing machine washing, even with gentle agitation, and minimal sifting through the pouch results, even upon vigorous shaking before addition of the article to the wash water. Thus, on such shaking, less than 0.1% of the composition is lost and in normal packaging, transportation and storage before use none escapes from the pouch. On the other hand, if the silicone glycol copolymer is omitted from the contained composition and extra fabric softening cationic compound is present to make the article satisfactorily softening in use, more than 20% of the composition will often remain in the pouch at the end of a gentle automatic washing machine washing cycle, at 21° C. To obtain these desirable results with the invented articles it is considered that openings in the pouch fabric should be held to less than 0.1 mm. in width or diameter, and should be large enough to allow the passage through them of aqueous liquids and finely divided particles, such as particles of insoluble components of the contained detergent composition, e.g., zeolites, the ultimate sizes of which were previously mentioned.

The pouch material is desirably flexible, as woven and non-woven fabrics almost invariably are, because during the operation of the washing machine, flexible containers or pouches, by frequently changing shape, can help to promote passage of fluids through their walls, which aids in evacuating of contained composition from such containers. Experimental work has established that the better the agitation the more complete the emptying of the pouch will be during a washing operation, and the use of a flexible pouch, with a contained detergent composition comprising SGC and of reduced cationic softener content, favors complete evacuation and transport of the contained composition through the pouch walls during washing, even at agitation conditions that are less than optimum (normal or gentle washing cycle, at low temperatures and with a heavier load of laundry than is desirable).

In making of the invented fabric softening detersive articles, after completion of the manufacturing of the fabric softening detergent composition, such composition is fed to conventional packaging equipment, which automatically fills and heat seals the composition into cavities between strips of the described woven or non-woven fabrics, to make the flat pillow-shaped articles described herein. After such filling the various packets are cut from the formed strip, when desired, and are packed in boxes, larger envelopes, cartons or other suitable containers.

In use of the invented articles the consumer fills the washing machine with water, which may be of any hardness, but preferably is of a hardness in the range of 25 to 150 p.p.m., as calcium carbonate. The wash water, at a temperature in the range of 15° to 70° C., usually 20° to 40° C., is normally of a volume in the range of 50 to 75 liters per wash, and to such wash water one of the invented articles is added for lightly or normally soiled laundry, and two packets are added for more heavily soiled laundry. The laundry to be washed is then added to the washing machine, with the weight charged usually being in a range of 2 to 4 kg., and washing is commenced. The wash cycle normally takes from 10 minutes to one hour, preferably 15 to 30 minutes, and after washing the laundry is usually automatically rinsed twice or three times. It is then spin dried or otherwise has rinse water expressed from it, and is removed from the washing machine in damp state, together with the fabric softening detersive article(s). With such article it is placed in an automatic laundry dryer, where it is subjected to a normal hot or warm air drying, depending on fabric types. After completion of drying, tests of the laundry will show that it is satisfactorily cleaned, desirably soft, and contains no quat spots or yellow stains due to the quaternary fabric softener, and is satisfactorily brightened by the stilbene brightener of the composition. Examination of the invented article, upon removal from the dried laundry, normally shows that it has been completely evacuated of initially contained fabric softening detergent composition particles. Under poor conditions for solubilizing, as when the wash water is cool or cold, and gentle or minimal agitation is employed, sometimes a small proportion of builder salt, usually less than 5% and often less than 1% of that amount initially present, remains in the pouch. However, under normal conditions and often even under adverse conditions, when the invented article is removed from the washing machine and is not added to the dryer it will usually be found that the contents thereof have been completely evacuated or that only a very small proportion, less than 1% thereof, remains, evidencing that during the washing cycle (and possibly also during any rinsing cycles) the cationic fabric softener was transported through the permeable pouch to the washing or rinsing medium, wherein it acted to soften the laundry.

The following examples illustrate but do not limit the present invention. All parts are by weight and all temperatures are in ° C. in such examples, this specification and the appended claims, unless otherwise indicated.

EXAMPLE 1

To 40.722 parts of tap water in a conventional detergent crutcher there are added 0.402 part of Tinopal UNPA fluorescent brightener, 18.249 parts of sodium bicarbonate, 18.735 parts of sodium carbonate, (natural soda ash) and 21.892 parts of Zeolite 4A hydrate (anhydrous basis), to produce a 54.9% solids content crutcher mix, which is at a temperature of about 60° C. For improved crutching and absorbency of the spray dried beads, with acceptable bead strength, the crutcher mix is make by first adding the fluorescent brightener to the water in the crutcher, followed by the bicarbonate, the carbonate and zeolite. Such additions are made while the water or aqueous mix is being agitated, and the addition of the carbonate is in two steps, with 80% thereof being added in a first step, with maximum agitation, after which addition agitation is continued for about three minutes, followed by admixing of the balance of the carbonate, with agitation being continued for another minute, followed by addition of the zeolite. (Such mixing procedure is not the invention of the present inventors but resulted from research performed by a colleague, working for their assignee corporation). The crutcher mix resulting (100.000 parts) is then pumped to a conventional spray drying tower, in which it is dried in a hot drying gas at a temperature of about 400° C., to form 57.315 parts of spray dried base beads of sizes in the range of Nos. 10 to 100, U.S. Sieve Series, having a moisture content of about 9.6%. During the spray drying operation some of the bicarbonate is converted to carbonate, with the release of water and carbon dioxide.

After cooling of the base beads to room temperature, 79.320 parts of such base beads then have sprayed onto moving surfaces thereof, while the beads are being kept in motion in a suitable mixer, e.g., an inclined drum mixer, 17.964 parts of Tergitol® 24-L-60N and 2.271 parts of silicone glycol copolymer (Dow Corning 190 Surfactant) in the mutual solution at 25° C., and 0.445 part of perfume. The nonionic detergent-SGC solution is absorbed by such beads and penetrates into the interiors thereof, while also coating or at least partially coating the beads. The moisture content of the 100.000 parts of intermediate product resulting is about 7.6%.

Such intermediate particulate product is then blended with other particulate or powdered components of the final formula of the fabric softening detergent composition. In such final blending, which also takes place in a suitable mixer for particulate materials, such as an inclined drum, 84.870 parts of the described particulate intermediate product are blended with: 1.060 parts of Maxatase MP 37500 (mixture of protease and emylase in a suitable carrier); 3.700 parts of an 80:20 blend of Alkaril QCF (PET-POET copolymer) and Alcosperse 107D (sodium polyacrylate); 4.700 parts of softener pre-mix; and 0.670 part of Microcel C (hydrated synthetic calcium silicate flow improving agent). The softener pre-mix includes 4.136 parts of dimethyl distearyl ammonium chloride, 0.376 part of higher fatty alcohol ethylene oxide condensation product (a surfactant-/emulsifier, in which the higher fatty alcohol averages 12 to 18 carbon atoms and is condensed with about 20 moles of ethylene oxide per mole), and 0.047 part of Microcel C. The balance of 0.141 part of the softener pre-mix is primarily moisture, which may be present with the cationic softener component of the pre-mix, as supplied, but may also include other impurities. The additional 0.670 part of Microcel C is added to improve flowability of the final product. Microcel C is also present in the softener pre-mix to improve the flowability thereof. Nonionic surfactant is present in the softener pre-mix to promote wetting of the softener, dispersion of it in the aqueous medium that is formed in the pouch after addition of the article to the wash water, and transport of the softener through the pouch walls.

The following is the formula of the final fabric softening detergent composition made, which is the contents of the pouches, to be described.

| Component | Parts (by weight) |
|---|---|
| Sodium carbonate | 29.868 |
| Sodium bicarbonate | 12.291 |
| Zeolite (anhydrous basis) | 21.783 |
| Neodol 25-7 | 16.144 |
| Silicone glycol copolymer (190 Surfactant) | 2.041 |
| Alkaril QCF | 2.960 |
| Alcosperse 107D | 0.740 |
| Dimethyl distearyl ammonium chloride | 4.136 |
| Condensation product of higher fatty alcohol averaging 12–18 carbon atoms with 20 moles of ethylene oxide per mole | 0.376 |
| Microcel C | 0.717 |
| Enzyme mixture (proteolytic and amylolytic mixture) | 1.060 |
| Fluorescent brightener (stilbene type) | 0.500 |
| Perfume | 0.400 |
| Water | 6.984 |
| | 100.000 |

The fabric softening detergent composition of this example is comprised of particles which are substantially within the range of Nos. 10 to 100, U.S. Sieve Series, with over 90%, by weight, of the particles being within that range and often with over 95% thereof being of such sizes. Oversized and undersized particles may be removed by screening or other classification operations. It is preferred for all the particles to be within the Nos. 10 to 60 range, with smaller particles often being adhered to or coating larger particles so as to make their effective particle sizes larger, and within such range. Thus, it may be considered that finely divided powdered components of such products, such as those admixed in the final blending, which sometimes may be of particle sizes as small as No. 200, U.S. Sieve Series, can deposit on and coat larger particles of the base beads. Such larger particles contain nonionic detergent, SGC and perfume, which may help to hold the smaller particles.

The fabric softening detergent composition described in satisfactorily free flowing, and can pass through a restricted orifice or exit passageway from a container at a velocity about 70% of that of dry sand, thereby meeting a standard for good flowability of spray dried detergent compositions.

After manufacture, the particulate composition may be aged (which is often preferred) before being filled into water permeable pouches, but in some instances it may be filled directly, without any intermediate aging. Such filling is preferably by automatic packaging machiner, in the operation of which strips of fabric or web material are fed in parallel, the particulate composition is fed between them, into a pocket created by the machine, the edges of the strips are heat sealed or otherwise fastened together and individual packets or pouches are separated from the strip, as by automatic cutting operations. The filled pouches are then packed in cartons for warehousing, shipping and sale.

The webbed material, employed as a feed to the automatic package making and filling machine, is a 100% nonwoven polyester material, Kendall SP 284.1, which is made of 3-denier polyester fiber. Such fabric weighs approximately 40 g./sq. m. and is of an air permeability of about 2 cu. m./min./sq. cm. The article made is essentially aquare, with the filled volume, excluding heat sealed edges, measuring about 10 cm. by 10 cm. by 1 cm. It contains 49 grams of composition, the bulk density of which is about 0.5 or 0.6 g./cu. cm.

Practical laundry tests are run, in which the described product is compared to a control composition, from which the SGC has been omitted, and washed laundry swatches of cotton, polyester and cotton-polyester blends are compared for cleanliness and softness. It is found that both the experimental and control swatches are satisfactorily and about equally clean but the experimentals are noticeably softer to the touch than the controls. In softness evaluations employing a 20-member experienced test panel, there were compared for softness washed swatches washed in (a) the composition of this example minus the SGC; (b) the composition of this example minus the cationic softener; and (c) the composition of this example. Such tests were run five times. On average (a) was rated unacceptable (not soft enough to satisfy the consumer), (b) was rated little different in softness than swatches washed in detergent compositions without any SGC and without any cationic fabric softener (d), and (c) was rated satisfactorily soft. Numerically, on a scale of softness, increasing from 1 to 10, average ratings are: (a) 4.8; (b) 2.8; (c) 7.2; and (d) 1. In the opinion of expert evaluators for fabric softness and of formulators of softergents (fabric softening detergent compositions) the improvement in softening action of Formula (c) over Formula (a) is significant and unexpected because the 2.8 rating for Formula (b) is so low that one skilled in this art would not have expected the addition of the described amount of SGC of Formula (b) to the composition of Formula (a) to result in the improved softening exhibited by Formula (c). That is because 1–3 indicate no softening or very little softening, 4–6 indicate little (but detectable) softening, and 7 and 8 indicate good softening (for a softergent). Evaluations of 9 and 10 are usually unobtainable with softergents, but can result from rinse treatments of fabrics with cationic softeners.

In addition to the satisfactory cleaning and significantly improved softening they exhibit, the articles of this example are substantially entirely emptied of their contents during the washing machine operation, employing a normal washing cycle with normal agitation (in a 60 minute wash at 38° C.). Also, substantial evacuation of the pouch results even when the washing temperature is lowered to about 20° C. No quat-spotting or yellowing of the laundry is observed under such conditions. However, when the content of cationic fabric softener (DMDSAC) is increased to 7% (from about 4%) to improve fabric softening accordingly) and the SGC is omitted, an objectionable proportion, sometimes greater than 10% of the amount of cationic softener initially present, may remain in the pouch after completion of the washing operation, and can quat-spot the laundry and cause yellowing of it by transfers of fabric softener in the dryer in high local concentrations to the washed laundry. Thus, it has been shown that the presence of a small proportion of SGC, although too small in itself to possess any significant fabric softening action, unexpectedly significantly improves the fabric softening of cationic softener in the compositions of this invention and in the described articles.

Similar results are obtained when, instead of charging one or two 49 gram packets of the invention to the washing machine (64 gallons of wash water of 150 p.p.m. as $CaCO_3$), depending on the dirtiness of the laundry, the composition is charged to the wash water directly. However, desired convenience of use is lost and therefore the invented articles are preferred.

Recently it has been found that the described article and composition of this example, as given in the formula, can be further improved, to exhibit even better fabric softening (averaging 7.9 on the scale previously described) by increasing the cationic softener content about 30%, from 4.136% to 5.394%, and at the same time reducing the SGC content by 50%, to 1.021% from 2.041%. The content of zeolite in the formula may be decreased to compensate for the approximately 0.2% increase. Such composition and corresponding articles possess the other advantages of the previously described products but because they better soften laundry, they are now preferred.

When similar articles and compositions like those previously described are made, in which other nonionic detergents, such as Neodol 25-7 and Neodol 23-6.5 (of the BRE type) are substituted for the Tergitol 24-L-60N (NRE), the same type of improvement in fabric softening is obervable and articles and compositions that do not cause quat-spotting are obtainable. However, the compositions and articles made incorporating NRE nonionic detergents are considered to be superior in detergency with respect to oily stains on laundry and, as was described in U.S. patent application Ser. No. 084,524 (Holland and Buda), they also synergistically improve soil release promoting actions of PET-POET copolymers. Furthermore, as was previously mentioned, the NRE's are of lower melting points, and so make better solutions with the SGC and are more readily absorbed by the base beads than mixes of SGC with BRE nonionic detergents. When in the described NRE and BRE detergent compositions and articles the dimethyl distearyl ammonium chloride is replaced with dimethyl di-tallowalkyl ammonium chloride or dimethyl d-hydrogenated tallowalkyl ammonium chloride substantially the same results will be obtained.

EXAMPLE 2

To 50.251 parts of tap water in a conventional detergent crutcher (or soap crutcher) there are added 0.422 part of fluorescent brightener (Tinopal UNPA, manufactured by CIBA-Geigy Corp.), 8.658 parts of 47.5% aqueous sodium silicate solution ($Na_2O:SiO_2=1:2.4$) and 40.669 parts of pentasodium tripolyphosphate (humidified) to produce a 45% solids content crutcher mix, which is at a temperature of about 60° C. The crutcher mix is then pumped to a conventional spray drying tower, wherein it is dried in a hot drying gas at a temperature of about 400° C., to form 52.001 parts of spray dried base beads of sizes in the range of Nos. 10 to 100, U.S. Sieve Series, having a moisture content of about 13%. After cooling, 72.594 parts of such base beads are mixed with 3.690 parts of similarly sized $Na_2SO_4$ filler beads and 3.000 parts of water (to adjust the composition to desired proportions of active components) and there are sprayed onto moving surfaces of the mixture a common solution of 18.000 parts of Tergitol 24-L-60N (condensation product of a higher fatty alcohol averaging 12 to 14 carbon atoms per molecule with a NRE distribution ethylene oxide polymer of 6 to 7 moles of EtO per mole, available from Union Carbide Corp.) and 2.271 parts of 190 Surfactant, at about 25° C. Instead of using Tergitol 24-L-60N there may be substituted other suitable NRE nonionic detergents, such as Neodol 23-7P and Neodol 23-7Z, available from Shell Development Co. Instead of spraying the mutual solution onto the mixed beads it may be sprayed onto the phosphate-silicate beads and the sulfate beads may then be admixed. In either case the mutual solution is absorbed by the beads and penetrates into the interiors thereof, while also coating them. Additionally, 0.445 part of perfume is also sprayed onto such moving beads. The moisture content of the intermediate product resulting is about 12.5%.

Such intermediate particulate product is then blended with other particulate or powdered components of the final formula of the fabric softening detergent composition. In such final blending, which also takes place in a suitable mixer for particulates, such as an inclined drum, 84.970 parts of the previously described intermediate detergent product are blended with: 1.060 parts of a mixture of proteolytic and amylolytic enzymes (Maxatase MP 37500); 3.700 parts of an 80:20 blend of PET-POET copolymer (Alkaril QCF, of weight average molecular weight of about 22,000, with the molecular weight of the polyoxyethylene being about 3,400 and the molar ratio of PET to POET units being about 3:1 (manufactured by Alkaril Chemicals, Inc.), and Alcosperse 107D (sodium polyacrylate of molecular weight of about 2,000); 4.700 parts of softener pre-mix; 0.670 part of Microcel C.; and 4.900 parts of sodium sulfate beads, that are blended in to adjust the formula proportions of components, as desired. The softener pre-mix includes 4.136 parts of dimethyl distearyl ammonium chloride, 0.376 part of higher fatty alcohol ethylene oxide condensation product (surfactant and emulsifier) in which the higher fatty alcohol averages 12 to 18 carbon atoms and is condensed with about 20 moles of ethylene oxide per mole, and 0.047 part hydrated synthetic calcium silicate (Microcel C). The balance of 0.141 part of the softener pre-mix is primarily moisture, which may be present in the cationic softener component of the pre-mix. The additional 0.670 part of Microcel C is added to improve flowability of the final product. Some Microcel C is also present in the softener pre-mix to improve flowability thereof and the nonionic surfactant is present in it to promote ready wetting of the softener, dispersion of it in the aqueous medium that is present in the pouch after addition of the article to the wash water, and transport of the softener through the pouch walls (when the composition is the contents of a pouch).

The following is the approximate formula of the fabric softening detergent composition made, which is contained in the invented articles of this examples.

| Component | Parts (by weight) |
|---|---|
| Phosphate solids (from sodium tripoly phosphate) | 48.0 |
| Silicate solids (from sodium silicate, of ($Na_2O:SiO_2$ = 1:2.4) | 4.9 |
| Polyethoxylated higher fatty alcohol (Neodol 25-7) | 17.1 |
| Tergitol 24-L-60N | 2.3 |
| Alkaril QCF | 3.0 |
| Alcosperse 107D | 0.7 |
| Dimethyl distearyl ammonium chloride | 4.1 |
| Polyethoxylated higher fatty alcohol (condensation product of higher fatty alcohol averaging 12–18 carbon atoms with 20 moles of ethylene oxide per mole) | 0.4 |
| Microcel C | 0.7 |
| Enzymes mixture | 1.1 |
| Fluorescent brightener | 0.5 |
| Perfume | 0.4 |
| $Na_2SO_4$ | 5.8 |
| Water | 11.0 |
| | 100.0 |

The final fabric softening detergent composition described above is of particle sizes and distributions like those of the product of Example 1 and may be packed in pouches in similar manner. When such particulate composition and fabric softening detersive articles made from it, in the manner described in Example 1, are subjected to testing comparable beneficial results are obtained. The compositions and articles containing the NRE nonionic detergent plus SGC are unexpectedly better in fabric softening than those from which the SGC has been omitted. Similar but even better softening results obtain when the cationic softener content is increased by 30% and the SGC content is cut in half, as in Example 1. When BRE nonionic detergents replace the NRE's (Neodol 25-7 replacing Tergitol 24-L-60N) similar results are obtained.

The articles made all are satisfactorily evacuated of contents during normal machine washing. The laundry done with them is clean and soft and is not quat-spotted or yellowed. A bromophenol blue dye test, in which the dye acts as a tracer for the quaternary ammonium chloride, indicates that the presence of the SGC helps to more evenly apply the quaternary salt to the laundry and thereby increases its activity.

EXAMPLE 3

(Additional Variations of the Invention)

Other fabric softening detergent compositions comprising other components described in the specification may be made and may be employed separately or may be filled into pouches, as in the foregoing examples, to produce articles which will satisfactorily evacuate the contained compositions and will clean and soften laundry. Thus, in addition to, or at least in partial replacement of, the particular BRE and NRE nonionic detergents recited in the mentioned examples, there may be employed other nonionic detergents, such as Neodol 23-6.5; Igepal CO-630; and Pluronic F-68, or equivalents, and corresponding NRE nonionic detergents, and the builders may be varied, as taught in the specification. Similarly, other cationic softening compounds, including other quaternary ammonium compounds, e.g., cetyl trimethyl ammonium bromide, dimethyl ditallowalkyl ammonium chloride, and imidazolinium salts, e.g., 2-heptadecyl-1-methyl-1-[(2-stearoylamido)ethyl]imidazolinium methyl sulfate, may be employed. The SGC may be replaced by other suitable silicone polymers, such as Silwet L-7001, or by mixtures of such components. The various adjuvants present in the compositions of the examples may be varied and some or all of them may be omitted (except that some moisture is normally present).

In addition to the substitutions of other components for those of the proceding examples (such other components are mentioned in the present specification), the proportions of components, as given in the examples, may be varied, for example, ±10%, and ±25%, providing that such proportions are kept within the ranges recited in this specification.

Instead of employing a non-woven polyester fabric pouch, such pouches may be made of other materials, including mixed polyester-cotton, e.g., 50:50 polyester:-cotton, rayon, nylon, blends of such synthetics and blends thereof with natural fibers, such as blends with cotton. The fabrics may be woven or non-woven and the fibers may be of different deniers (although preferably they will be of about the same denier), weights and permeabilities, providing that such allow the satisfactory evacuation of the composition from the pouch (or other permeable container) during automatic washing machine washing of laundry, but normally the denier, weight of fabric and its permeability will be within preferred ranges given in the specification.

Although the pouches for the invented articles are very preferably automatically manufactured by package making and filling equipment they may also be made by hand, and instead of the edges being heat sealed they may be sealed by adhesive, solvent, fusion of the polymeric material, stitching or stapling. The size, shape, weight of contents and density of contents in the pouch may be varied and such pouches may be replaced by permeable containers of fixed size and shape, such as closed end tubes.

In the manufacturing of the detergent composition, instead of spraying the mutual solution of nonionic detergent and SGC onto the base beads, the nonionic detergent and SGC components may be separately absorbed by such beads, but it is preferred to apply them as the described single solution to save an additional operation and to promote penetration into the pores of the beads. The temperature of application may be changed to any suitable temperature at which the mixture is in liquid state but normally will be about room temperature. In some instances, instead of spraying the liquid onto the moving base beads, such application may be made by dripping the liquid onto the beads or applying it to them as a stream or "sheet". In such instances reliance will be on maintaining the bed of beads sufficiently agitated to distribute the liquid over the surfaces thereof.

In the washing of laundry with compositions or articles of this invention improved fabric softening is obtainable. When the invented articles are employed the consumer is always assured of having the right amount of detergent composition in the wash water for a normal wash load, and pouring and measuring of detergent powder are avoided. The wash water hardness will normally be less than 300 p.p.m., as $CaCO_3$, but harder waters can be used. Washing temperature will often be cool and almost always will be less than 70° C. but higher temperatures are operative and sometimes the use of higher temperature wash waters can be more desirable, because heat promotes the solubilizing of the contained composition and thereby aids in transporting it through permeable container walls. The washed laundry will usually contain some synthetic fabrics or mixed synthetic-natural fabrics but the invention is operative with laundry made only of natural fibrous material, e.g., cottons. After washing in the washing machine (which is normally automatic) the laundry is usually machine dried but improved fabric softening, compared to a control, is noted for laundry items that are line dried, too, although improvements in softening thereof may not be as significant.

Where, in the above description molecular weights and/or carbon atom contents of compounds were given they may be considered to apply to average molecular weights and contents, as well as actual molecular weights and contents.

The invention has been described with respect to illustrations and working embodiments thereof but it is not to be considered as limited to these because it is evident that one of skill in the art will be able to utilize substitutes and equivalents without departing from the invention.

What is claimed is:

1. A fabric softening detergent composition which comprises a detersive proportion of nonionic detergent, a building proportion of builder for the nonionic detergent, and a fabric softening proportion of a combinatin of fabric softening cationic compound and silicone glycol copolymer, for which copolymer a hydrophilic-lipophilic balance number is in the range of 4 to 19, and in which the copolymer is of ethylene glycol and propylene glycol, wherein the proportion of silicone glycol copolymer significantly improves the fabric softening action of the fabric softening cationic compound.

2. A fabric softening detergent composition according to claim 1 wherein the proportion of nonionic detergent is in the range of 8 to 40%, the proportion of builder is in the range of 30 to 70%, the proportion of fabric softening cationic compound is in the range of 0.5 to 10% and the proportion of silicone glycol copolymer is in the range of 0.5 to 8%, and the silicone glycol copolymer is of the formula

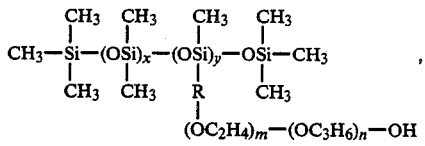

wherein R is a hydrocarbyl radical of 1 to 30 carbon atoms, x is 6 to 420, y is 3 to 30, and $m+n=25$ to 100, with the molar proportion of ethoxy groups to propoxy groups being in the range of 1:4 to 7:3, which composition is in particulate form and is suitable for heavy duty washing of laundry in an automatic washing machine.

3. A fabric softening detergent composition according to claim 2 wherein the nonionic detergent is a condensation product of ethylene oxide and higher fatty alcohol, in which the higher fatty alcohol averages in the range of 10 to 18 carbon atoms and the ethylene oxide content of the nonionic detergent averages in the range of 3 to 15 moles of ethylene oxide per mole of higher fatty alcohol, the builder salt is selected from the group consisting of alkali metal tripolyphosphate, alkali metal silicate, alkali metal carbonate, alkali metal bicarbonate, alkali metal borate, alkali metal citrate, alkali metal gluconate, NTA, zeolite, and mixtures thereof, the fabric softening cationic compound is of the formula

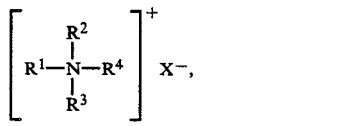

wherein $R^1$ and $R^2$ are lower alkyl of 1 to 3 carbon atoms, $R^3$ is higher alkyl of 10 to 20 carbon atoms, $R^4$ is alkyl of 1 to 20 carbon atoms, and X is either chlorine or bromine, and in the silicone glycol copolymer formula R is lower alkylene of 1 to 10 carbon atoms, x is 10 to 350, y is 5 to 25 and $m+n=40$ to 80, with the molar proportion of ethoxy groups to propoxy groups being in the range of 1:2 to 2:1.

4. A fabric softening detergent composition according to claim 3 wherein the nonionic detergent is a condensation product of ethylene oxide and higher fatty alcohol in which the higher fatty alcohol averages 10 to 16 carbon atoms and the ethylene oxide content of the nonionic detergent averages 3 to 10 moles of ethylene oxide per mole, the builder is a mixture of sodium carbonate, sodium bicarbonate and hydrated zeolite, with the weight of sodium carbonate being from 0.7 to 1.5 times the weight of zeolite (anhydrous basis) and the weight of sodium bicarbonate being from 0.3 to 0.7 times the weight of sodium carbonate, the quaternary ammonium salt is a di-lower alkyl di-higher alkyl ammonium chloride wherein the lower alkyls are of 1 to 2 carbon atoms and the higher alkyls are of 12 to 20 carbon atoms, and in the silicone glycol copolymer R is of 1 to 5 carbon atoms.

5. A fabric softening detergent composition according to claim 4 wherein the proportion of nonionic detergent in the detergent composition is 12 to 25%, the proportion of builder salt mixture therein is 40 to 70%, the proportions of sodium carbonate, sodium bicarbonate and hydrated zeolite, as the anhydride, being 15 to 35%, 5 to 20% and 10 to 35%, respectively, the proportion of quaternary ammonium salt is 1 to 6%, and the proportion of silicone glycol copolymer is 0.5 to 5%.

6. A fabric softening detergent composition according to claim 5 wherein the higher fatty alcohol of the nonionic detergent is a mixture of higher fatty alcohols averaging 12 to 15 carbon atoms in the molecules thereof, the ethylene oxide content of the nonionic detergent averages 6 to 7 moles per mole of higher fatty alcohol, the content of nonionic detergent in the detergent composition is about 16%, the proportion of inorganic builder salt mixture is about 30% of sodium carbonate, about 12% of sodium bicarbonate and about 22% of hydrated sodium zeolite (anhydrous basis), the quaternary ammonium salt is dimethyl distearyl ammonium chloride and the proportion thereof in the detergent composition is about 4 to 5%, the silicone glycol copolymer is one of a formula wherein R is alkylene of 3 carbon atoms, and the molar proportion of ethoxy groups to propoxy groups is in the range of 2:3 to 3:2, and the proportion of the silicone glycol copolymer in the detergent composition is about 1 to 2%, with all percentages and proportions being on a final product weight basis, except for the zeolite percentage, which is a percentage of anhydrous zeolite (water of hydration being removed) on such final product basis.

7. A fabric softening detergent composition according to claims 6 which is of spray dried builder beads which contain the sodium carbonate, sodium bicarbonate and hydrated zeolite, and are of particle sizes in the range of Nos. 10 to 100, U.S. Sieve Series, having absorbed therein the higher fatty alcohol ethylene oxide condensate nonionic detergent and the silicone glycol copolymer, and having the particulate fabric softening dimethyl distearyl ammonium chloride mixed with, adhering to and coating such buildersnonionic detergent-copolymer particles.

8. A fabric softening detergent composition according to claim 7 in which the fabric softening detergent composition also comprises about 3% of polyethylene terephthalatepolyoxyethylene terephthalate (PET-POET) soil release promoting copolymer of molecular weight in the range of 19,000 to 43,000, with the molecular weight of the polyoxyethylene thereof being in the range of about 2,500 to 5,000, with the molar ratio of PET to POET units being in the range of 2:1 to 6:1 and with the proportion of ethylene oxide to phthalic moiety in the copolymer being in the range of 20:1 to 30:1, about 1% of proteolytic-amylolytic enzymes mixture, about 0.7% of sodium polyacrylate of molecular weight in the range of 1,000 to 3,000, about 0.7% of calcium silicate as a flow promoting agent, about 0.5% of fluorescent brightener, about 0.4 of perfume and about 8% of water.

9. A fabric softening detergent composition according to claim 4 wherein the nonionic detergent is a narrow range ethoxylate (NRE), which is a polyethoxylated lipophile, ethoxylated with an average of 5 to 10 ethylene oxide groups per mole, and with at least 70% of the ethylene oxide being in polyethoxy groups of 4 to 12 moles of ethylene oxide.

10. A fabric softening detergent composition according to claim 8 wherein the nonionic detergent is a narrow range ethoxylate (NRE) in which the higher fatty alcohol moiety is saturated and is of 12 to 14 carbon atoms, and over 85% of the ethylene oxide present in the polyethoxy moiety of such NRE is present as polyethoxy groups of 5 to 10 moles of ethylene oxide.

11. A fabric softening detergent composition according to claim 3 wherein the nonionic detergent is a condensation product of ethylene oxide and higher fatty alcohol in which the higher fatty alcohol averages 10 to 16 carbon atoms and the ethylene oxide content of the nonionic detergent averages 3 to 10 moles of ethylene oxide per mole, the builder is a mixture of sodium tripolyphosphate and sodium silicate with the weight of the tripolyphosphate being from 5 to 20 times the weight of the silicate, the quaternary ammonium salt is a di-lower alkyl di-higher alkyl ammonium chloride wherein the lower alkyls are of 1 to 2 carbon atoms and the higher alkyls are of 12 to 20 carbon atoms, and in the silicone glycol copolymer R is of 1 to 5 carbon atoms.

12. A fabric softening detergent composition according to claim 11 wherein the proportion of nonionic detergent in the detergent composition is 12 to 25%, the proportion of builder salt mixture therein is 43 to 68%, the proportions of sodium tripolyphosphate and silicate being 40 to 60% and 3 to 8%, respectively, the proportion of quaternary ammonium salt therein is 1 to 6%, and the proportion of silicone glycol copolymer is 0.5 to 5%.

13. A fabric softening detergent composition according to claim 1 wherein the fabric softening particulate built laundry detergent composition is of spray dried builder beads having absorbed therein the nonionic detergent and silicone glycol copolymer and having particulate fabric softening cationic compound mixed with such builder-nonionic detergent-copolymer particles.

14. A fabric softening detergent composition according to claim 12 wherein the higher fatty alcohol of the nonionic detergent is a mixture of higher fatty alcohols averaging 12 to 15 carbon atoms in the molecules thereof, the ethylene oxide content of the nonionic detergent averages 6 to 7 moles per mole of higher fatty alcohol, the content of nonionic detergent in the detergent composition is about 16%, the water soluble inorganic builder salt mixture is about 55% of pentasodium tripolyphosphate and about 5% of sodium silicate, of $Na_2O:SiO_2$ ratio of about 1:2.4, the quaternary ammonium salt is dimethyl distearyl ammonium chloride and the proportion thereof in the detergent composition is about 4 to 5%, and the silicone glycol copolymer is one of a formula wherein R is alkylene of 3 carbon atoms, and the molar proportion of ethoxy groups to propoxy groups is in the range of 2:3 to 3:2, and the proportion of the silicone glycol copolymer in the detergent composition is about 1 to 2%, with all percentages and proportions being on a final product weight basis.

15. A fabric softening detergent composition according to claim 14 which is of spray dried builder beads, which contain pentasodium tripolyphosphate and sodium silicate, and are of particle sizes in the range of Nos. 10 to 100, U.S. Sieve Series, having absorbed therein the higher fatty alcohol ethylene oxide condensate nonionic detergent and the silicone glycol copolymer, and having the particulate fabric softening dimethyl distearyl ammonium chloride mixed with, adhering to and coating such builders-nonionic detergent-copolymer particles.

16. A fabric softening detergent composition according to claim 15 in which the fabric softening detergent composition also comprises about 3% of polyethylene terephthalate-polyoxyethylene terephthalate (PET-POET) soil release promoting copolymer of molecular weight in the range of 19,000 to 43,000, with the molecular weight of the polyoxyethylene thereof being in the range of about 2,500 to 5,000, with the molar ratio of PET to POET units being in the range of 2:1 to 6:1, and with the proportion of ethylene oxide to phthalic moiety in the copolymer being in the range of 20:1 to 30:1, about 1% of proteolytic-amylolytic enzymes mixture, about 0.7%, of sodium polyacrylate of molecular weight in the range of 1,000 to 3,000, about 0.7% of calcium silicate, as a flow promoting agent, about 0.5% of fluorescent brightener, about 0.4% of perfume, and about 11% of water.

17. A fabric softening detergent composition according to claim 13 wherein the nonionic detergent is a narrow range ethoxylate (NRE), which is a polyethoxylated lipophile, ethoxylated with an average of 5 to 10 ethylene oxide groups per mole, and with at least 70% of the ethylene oxide being in polyethoxy groups of 4 to 12 ethylene oxides.

18. A fabric softening detergent composition according to claim 15 wherein the nonionic detergent is a narrow range ethoxylate (NRE), in which the higher fatty alcohol moiety is saturated and is of an average of 12 to 14 carbon atoms and over 85% of the ethylene oxide present in such NRE is present as polyethoxy groups of 5 to 10 moles of ethylene oxide.

19. A process for manufacturing a fabric softening detergent composition, suitable for dispensing into wash water in an automatic washing machine from a water permeable, water insoluble container through a permeable wall thereof, which comprises spray drying an aqueous crutcher mix of builder(s) to produce porous base beads, making a liquid composition of 0.5 to 8 parts of silicone glycol copolymer in 8 to 40 parts of a condensation product of ethylene oxide and higher fatty alcohol, in which nonionic detergent the fatty alcohol moiety averages 10 to 16 carbon atoms and the polyethoxy moiety averages 3 to 10 moles of ethylene oxide per mole, with the proportion of such silicone glycol copolymer to such nonionic detergent being in the range of 1:30 to 1:4, at a temperature in the range of 10° to 40° C., spraying such nonionic detergent-silicone glycol copolymer solution onto the spray dried porous builder base beads, by which they are absorbed, and applying to such nonionic detergent-silicone glycol copolymer-builder beads, particulate fabric softening cationic compound, which adheres to and coats such beads, resulting in a composition in accordance with claim 1.

20. A process according to claim 19 wherein the aqueous crutcher mix is of 50 to 75% solids content, which solids comprise sodium tripolyphosphate and sodium silicate, with the weight of the tripolyphosphate being from 5 to 20 times the weight of the silicate, or comprise sodium carbonate, sodium bicarbonate and zeolite builders, with the weight of sodium carbonate being from 0.7 to 1.5 times the weight of zeolite (anhydrous basis) and the weight of sodium bicarbonate being from 0.3 to 0.7 times the weight of sodium carbonate (spray dried bead basis), the spray dried beads are of particle sizes in the range of Nos. 10 to 100, U.S. Sieve Series, the nonionic detergent is a higher fatty alcohol polyethoxylate wherein the higher fatty alcohol averages 12 to 15 carbon atoms per molecule and the polyethoxy moiety averages 6 to 7 moles per mole, the silicone glycol copolymer is of the formula

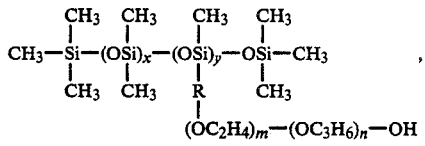

wherein R is a hydrocarbyl radical of 1 to 30 carbon atoms, x is 6 to 420, y is 3 to 30, and $m+n=25$ to 100, with the molar proportion of ethoxy groups to propoxy groups being in the range of 1:4 to 7:3, the temperature of the liquid composition is about room temperature, the liquid composition comprises about 16 parts of said nonionic detergent and about 1 to 2 parts of the silicone glycol copolymer, and the fabric softening cationic compound is distearyl dimethyl ammonium chloride, which is applied to the particulate nonionic detergent-silicone glycol copolymer-builder beads as a powder, which powder comprises about 4 to 5 parts of such cationic fabric softening compound, about 0.4 parts of higher fatty alcohol polyethoxylate emulsifying agent, and about 0.05 part of hydrated synthetic calcium silicate, as a flow aid, resulting in a composition in accordance with claim 2.

21. A liquid composition, useful for application in liquid state, at a temperature in the range of 10° to 40° C., to spray dried inorganic builder beads and for absorption by such beads to form particulate built synthetic organic detergent compositions, to which particulate fabric softening cationic compound may be applied to produce a fabric softening particulate built detergent composition, which comprises a mutual solution of 0.5 to 5 parts of silicone glycol copolymer and 12 to 25 parts of nonionic detergent, which is a condensation product of ethylene oxide and higher fatty alcohol in which the higher fatty alcohol averages 10 to 16 carbon atoms and the ethylene oxide content averages 3 to 10 moles of ethylene oxide per mole, with the proportion of such silicone glycol copolymer to such nonionic detergent being in the range of 1:30 to 1:4, and with such proportion of the copolymer significantly improving the fabric softening action of the fabric softening cationic compound when the liquid composition is absorbed into the spray dried beads and the resulting particulate composition is mixed with said cationic compound to make a fabric softening detergent composition, which is used to wash and soften laundry in an automatic washing machine.

22. A liquid composition according to claim 21 wherein the silicone glycol copolymer is of the formula

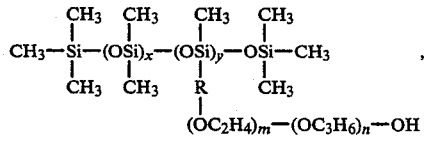

wherein R is a hydrocarbyl radical of 1 to 30 carbon atoms, x is 6 to 420, y is 3 to 30, and $m+n=24$ to 100, with the molar proportion of ethoxy groups to propoxy groups being in the range of 1:4 to 7:3, and the nonionic detergent is a higher fatty alcohol polyethoxylate wherein the higher fatty alcohol averages 12 to 15 carbon atoms per mole and the polyethoxy moiety averages 6 to 7 moles per mole, the proportion of such copolymer to such nonionic detergent in the liquid composition being in the range of about 1:16 to about 1:8, and the temperature of the liquid composition, at which temperature the components are mutually soluble and at which the composition is applicable as a spray to porous spray dried base beads of inorganic builders, is about room temperature.

23. A method of washing and softening laundry which comprises adding to wash water, at a temperature in the range of 15° to 70° C., a composition according to claim 1, and washing the laundry in such wash water.

24. A method according to claim 23 wherein the composition employed is one in which the nonionic detergent is a narrow range polyethoxylate (NRE) in which a higher fatty alcohol moiety is saturated and of 12 to 14 carbon atoms, and in which over 85% of the ethylene oxide present in the polyethoxy moiety of such NRE is present as polyethoxy groups of 5 to 10 moles of ethylene oxide, and the washing is of laundry containing oily stains on polyester fiber-containing fabrics and is carried out in an automatic washing machine, after which the laundry is dried in an automatic laundry dryer.

25. A method according to claim 24 wherein the composition employed is one in which the silicone glycol copolymer is of the formula

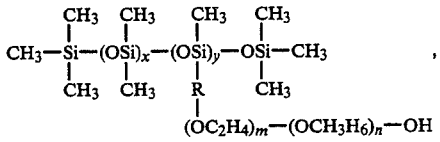

wherein R is a hydrocarbyl radical of 1 to 30 carbon atoms, x is 6 to 420, y is 3 to 30 and $m+n=25$ to 100, with the molar proportion of ethoxy groups to propoxy groups being in the range of 1:4 to 7:3.

26. A fabric softening and detersive article for use in an automatic washing machine to wash and soften laundry, which article comprises a fabric softening detergent composition in particulate form, according to claim 1, in a water permeable, water insoluble container, through a permeable wall of which container components of the fabric softening particulate detergent composition, in aqueous solution, emulsion and/or dispersion form, are transportable to wash water in the automatic washing machine during a washing cycle of such machine, so that substantially all of such composition passes out of the container and into the wash water during washing of laundry in the washing machine, so that laundry in the wash water may be washed and softened thereby.

27. A fabric softening and detersive article according to claim 26 wherein the water permeable insoluble container is a permeable pouch of thin material and the detergent composition contained therein is one in which the nonionic detergent is a condensation product of ethylene oxide and higher fatty alcohol, in which the higher fatty alcohol averages in the range of 10 to 18 carbon atoms and the ethylene oxide content of the nonionic detergent averages in the range of 3 to 15 moles of ethylene oxide per mole of higher fatty alcohol, the builder salt is selected from the group consisting of alkali metal tripolyphosphate, alkali metal silicate, alkali metal carbonate, alkali metal bicarbonate, alkali metal borate, alkali metal citrate, alkali metal gluconate, NTA, zeolite, and mixtures thereof, the fabric softening cationic compound is of the formula

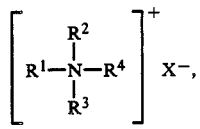

wherein $R^1$ and $R^2$ are lower alkyl of 1 to 3 carbon atoms, $R^3$ is higher alkyl of 10 to 20 carbon atoms, $R^4$ is alkyl of 1 to 20 carbon atoms, and X is either chlorine or bromine, the silicone glycol copolymer is of the formula

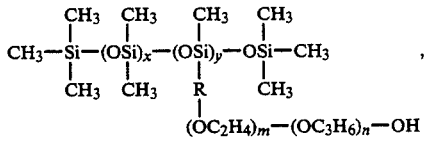

wherein R is a hydrocarbyl radical of 1 to 20 carbon atoms, x is 6 to 420, y is 3 to 30, and $m+n=25$ to 100, with the molar proportion of ethoxy groups to propoxy groups being in the range of 1:4 to 7:3, and the detergent composition contained in the pouch is in particulate form and comprises 8 to 40% of the nonionic detergent, 30 to 70% of the builder, 0.5 to 10% of the fabric softening cationic compound and 0.5 to 8% of the silicone glycol copolymer.

28. A fabric softening and detersive article according to claim 26 wherein the pouch is of non-woven polyester, nylon or rayon fibers, or any mixture thereof with each other or with other fibers, is heat sealed at at least one edge thereof, and is of a size to be readily holdable in a human hand, with a total permeable surface area in the range of 100 to 500 sq. cm., measured externally, containing fabric softening detergent composition in the range of 30 to 100 grams.

29. A fabric softening and detersive article according to claim 27 wherein the pouch is of non-woven polyester, nylon or rayon fibers, or any mixture thereof with each other or with other fibers, is heat sealed at at least one edge thereof, and is of a size to be readily holdable in a human hand, with a total permeable surface area in the range of 100 to 500 sq. cm., measured externally, containing fabric softening detergent composition in the range of 30 to 100 grams.

30. A method of washing and softening laundry which comprises adding an article according to claim 26, to wash water, at a temperature in the range of 15° to 70° C., in an automatic washing machine, and washing the laundry in such wash water.

31. A method according to claim 30 wherein the article employed is one wherein the water permeable insoluble container is a permeable pouch of thin material, the detergent composition contained therein is one in which the nonionic detergent is a condensation product of ethylene oxide and higher fatty alcohol, in which the higher fatty alcohol averages in the range of 10 to 18 carbon atoms and the ethylene oxide content of the nonionic detergent averages in the range of 3 to 15 moles of ethylene oxide per mole of higher fatty alcohol, the builder salt is selected from the group consisting of alkali metal tripolyphosphate, alkali metal silicate, alkali metal carbonate, alkali metal bicarbonate, alkali metal borate, alkali metal citrate, alkali metal gluconate, NTA, zeolite, and mixtures thereof, the fabric softening cationic compound is of the formula

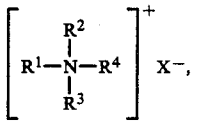

wherein $R^1$ and $R^2$ are lower alkyl of 1 to 3 carbon atoms, $R^3$ is higher alkyl of 10 to 20 carbon atoms, $R^4$ is alkyl of 1 to 20 carbon atoms, and X is either chlorine or bromine, and the silicone glycol copolymer is of the formula

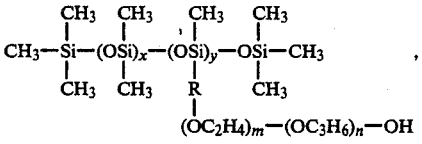

wherein R is a hydrocarbyl radical of 1 to 30 carbon atoms, x is 6 to 420, y is 3 to 30, and $m+n=25$ to 100, with the molar proportion of ethoxy groups to propoxy groups being in the range of 1:4 to 7:3, which detergent composition is in particulate form and comprises 8 to 40% of the nonionic detergent, 30 to 70% of the builder, 0.5 to 10% of the fabric softening cationic compound and 0.5 to 8% of the silicone glycol copolymer, and the temperature of the wash water is in the range of 15° to 30° C.

32. A method according to claim 31 wherein the article employed is one wherein the pouch is of nonwoven polyester, nylon or rayon fibers, or any mixture thereof with each other or with other fibers, is heat sealed at at least one edge thereof, and is of a size to be readily holdable in a human hand, with a total permeable surface area, through which detergent composition constituents can pass into wash water, in the range of 100 to 500 sq. cm., measured externally, and the contents of fabric softening detergent composition in the pouch are of a weight in the range of 30 to 100 grams.

33. A method according to claim 32 wherein the wash is of laundry containing oily stains on polyester fiber-containing fabrics.

* * * * *